US011566817B1

(12) United States Patent
Magaro

(10) Patent No.: US 11,566,817 B1
(45) Date of Patent: Jan. 31, 2023

(54) AIR CIRCULATION SYSTEM

(71) Applicant: Anthony Magaro, Camp Hill, PA (US)

(72) Inventor: Anthony Magaro, Camp Hill, PA (US)

( * ) Notice: Subject to any disclaimer, the term of this patent is extended or adjusted under 35 U.S.C. 154(b) by 373 days.

(21) Appl. No.: 16/821,476

(22) Filed: Mar. 17, 2020

Related U.S. Application Data

(60) Provisional application No. 62/822,114, filed on Mar. 22, 2019.

(51) Int. Cl.

| | |
|---|---|
| ***F24F 7/007*** | (2006.01) |
| ***F24H 3/02*** | (2022.01) |
| ***F24F 13/30*** | (2006.01) |
| ***F26B 9/00*** | (2006.01) |
| ***F26B 21/00*** | (2006.01) |
| *F24F 8/22* | (2021.01) |

(52) U.S. Cl.
CPC ..... *F24H 3/022* (2013.01); *F24F 7/007* (2013.01); *F24F 13/30* (2013.01); *F26B 9/003* (2013.01); *F26B 21/001* (2013.01); *F24F 8/22* (2021.01)

(58) Field of Classification Search
CPC ... F24F 13/30; F24F 7/007; F24F 8/22; F26B 9/003; F26B 9/00; F26B 21/001; F24H 3/022
USPC ..... 454/233
See application file for complete search history.

(56) References Cited

U.S. PATENT DOCUMENTS

| | | | | |
|---|---|---|---|---|
| 1,219,745 | A | 3/1917 | Keen | |
| 4,424,006 | A | 1/1984 | Armbruster | |
| 4,873,422 | A | 10/1989 | Streich et al. | |
| D358,873 | S | 5/1995 | Pelonis | |
| 5,421,701 | A | 6/1995 | Funston | |
| D366,934 | S | 2/1996 | Asselbergs | |
| 5,522,704 | A | 6/1996 | Casteel | |
| 5,601,636 | A | 2/1997 | Glucksman | |
| 5,957,701 | A * | 9/1999 | McMillin | H01R 25/006 439/32 |
| D422,353 | S | 4/2000 | Brewer | |
| D425,193 | S | 5/2000 | Brewer | |
| 6,202,322 | B1 | 3/2001 | Turner, IV | |

(Continued)

OTHER PUBLICATIONS

The Home Depot, "InVent 110 CFM Ceiling Bathroom Exhaust Fan with Humidity Sensing Fan, Energy Star," www.homedepot.com, accessed: Jul. 2018.

(Continued)

*Primary Examiner* — Avinash A Savani
*Assistant Examiner* — Ryan L Faulkner
(74) *Attorney, Agent, or Firm* — McNees Wallace & Nurick

(57) ABSTRACT

An air circulation system includes an outlet tap having a pair of prong outlets receivable by a corresponding pair of electrical outlets of an electrical receptacle mounted to a vertical wall and positioned near a support surface, the outlet tap having at least two electrical outlets opposite the pair of prong outlets for providing electrical power from one or both of the electrical outlets of the electrical receptacle. A support member operatively connected to the outlet tap, the support member is adapted to suspendedly support a fan vertically above the support surface in response to the outlet tap being received by the electrical receptacle. A timer and a humidistat are connectable to corresponding electrical outlets of the at least two electrical outlets of the outlet tap for selectively controlling operation of the fan.

18 Claims, 3 Drawing Sheets

(56) References Cited

U.S. PATENT DOCUMENTS

| | | | | |
|---|---|---|---|---|
| 6,280,211 | B1 | 8/2001 | Tateishi | |
| 6,283,709 | B1 | 9/2001 | Hill et al. | |
| 6,413,302 | B1 | 7/2002 | Harrison et al. | |
| 6,750,410 | B2 * | 6/2004 | Lee | H01R 25/003 200/51.03 |
| 6,821,095 | B2 | 11/2004 | Dooley et al. | |
| 6,862,403 | B2 | 3/2005 | Pedrotti et al. | |
| 6,935,570 | B2 | 8/2005 | Acker, Jr. | |
| 7,007,403 | B1 | 3/2006 | Studebaker | |
| 7,398,013 | B2 * | 7/2008 | He | A61L 9/122 392/394 |
| 7,862,371 | B1 | 1/2011 | Johnson | |
| 7,876,560 | B2 | 1/2011 | Huang | |
| 8,726,721 | B2 * | 5/2014 | Minges | G01N 1/2226 73/864.34 |
| 9,182,138 | B2 | 11/2015 | Foreman et al. | |
| 9,797,410 | B1 | 10/2017 | Tucker | |
| 2004/0156716 | A1 | 8/2004 | Kim et al. | |
| 2004/0175281 | A1 | 9/2004 | Remington | |
| 2006/0049615 | A1 | 3/2006 | Day | |
| 2006/0286922 | A1 | 12/2006 | Roux et al. | |
| 2010/0078494 | A1 * | 4/2010 | Mularoni | G05D 22/02 236/44 A |
| 2018/0195750 | A1 | 7/2018 | Wu et al. | |

OTHER PUBLICATIONS

Sahara Pro X3 TurboDryer, Hardwood Floor Finishing Dryer Fans/Air Movers, Floor Finishing Vacuum, www.floorfinishingvacuums.com, accessed: Jul. 2018.

Way Fair, "Doorway Wall Fan," www.wayfair.com, Way Fair—Plow & Hearth, accessed: Jul. 2018.

* cited by examiner

AIR CIRCULATION SYSTEM

CROSS REFERENCE TO RELATED APPLICATIONS

This application relates to and claims the benefit of U.S. Provisional Patent Application No. 62/822,114, filed Mar. 22, 2019, entitled "Air Circulation System," the disclosure of which is incorporated by reference in its entirety.

FIELD OF THE INVENTION

The present invention is directed to air circulation systems.

BACKGROUND OF THE INVENTION

Air circulation systems, such as fan units are commonly utilized for ventilation, assistance with climate and humidity control, and other reasons. In addition, air circulation may be used to assist with floor refinishing. However, there should be no air circulation during application of floor refinishing solvents, and once the floor refinishing solvents have been applied, it is not possible to position fans on the "wet" floor in order to speed the curing process.

There is need in the art for air circulation systems that do not suffer from one or more of the above drawbacks.

SUMMARY OF THE INVENTION

In an exemplary embodiment, an air circulation system includes an outlet tap having a pair of prong outlets receivable by a corresponding pair of electrical outlets of an electrical receptacle mounted to a vertical wall and positioned near a support surface, the outlet tap having at least two electrical outlets opposite the pair of prong outlets for providing electrical power from one or both of the electrical outlets of the electrical receptacle. The air circulation system further includes a support member operatively connected to the outlet tap, the support member adapted to suspendedly support a fan vertically above the support surface in response to the outlet tap being received by the electrical receptacle. The air circulation system further includes a timer and a humidistat connectable to corresponding electrical outlets of the at least two electrical outlets of the outlet tap for selectively controlling operation of the fan.

In another exemplary embodiment, an air circulation system includes an outlet tap having a pair of prong outlets receivable by a corresponding pair of electrical outlets of an electrical receptacle mounted to a vertical wall and positioned near a support surface, the outlet tap providing electrical power from one or both of the electrical outlets of the electrical receptacle. The air circulation system further includes the outlet tap further including a fan formed as a single unit, the fan vertically supported above the support surface solely by the outlet tap being received by the electrical receptacle. The air circulation system further includes the outlet tap further including a timer and a humidistat incorporated as a single unit, the timer and the humidistat for selectively controlling operation of the fan.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The air circulation system of the present application is positionable above a floor surface without requiring special equipment, i.e., utilizing conventional electrical outlets of an electrical receptacle mounted on a vertical wall near the floor surface, and is uniquely configured or adapted for use with floor refinishing. For example, the air circulation system includes a timer, permitting a floor refinisher to input a time delay prior to operation of the air circulation system sufficient for application and "settling" of the floor refinishing materials. That is, if moving air is prematurely applied to a coating or layer of refinishing materials, "skinning" may occur, which could impede the curing process. Furthermore, the air circulation system includes a self-supporting arrangement, permitting robust fans to be utilized. In one embodiment, the air circulation system includes one or more of UV lighting for illumination, curing of floor refinishing solvents and/or prevention of mold and mildew formation, a heating element, or other features.

Figure 1:
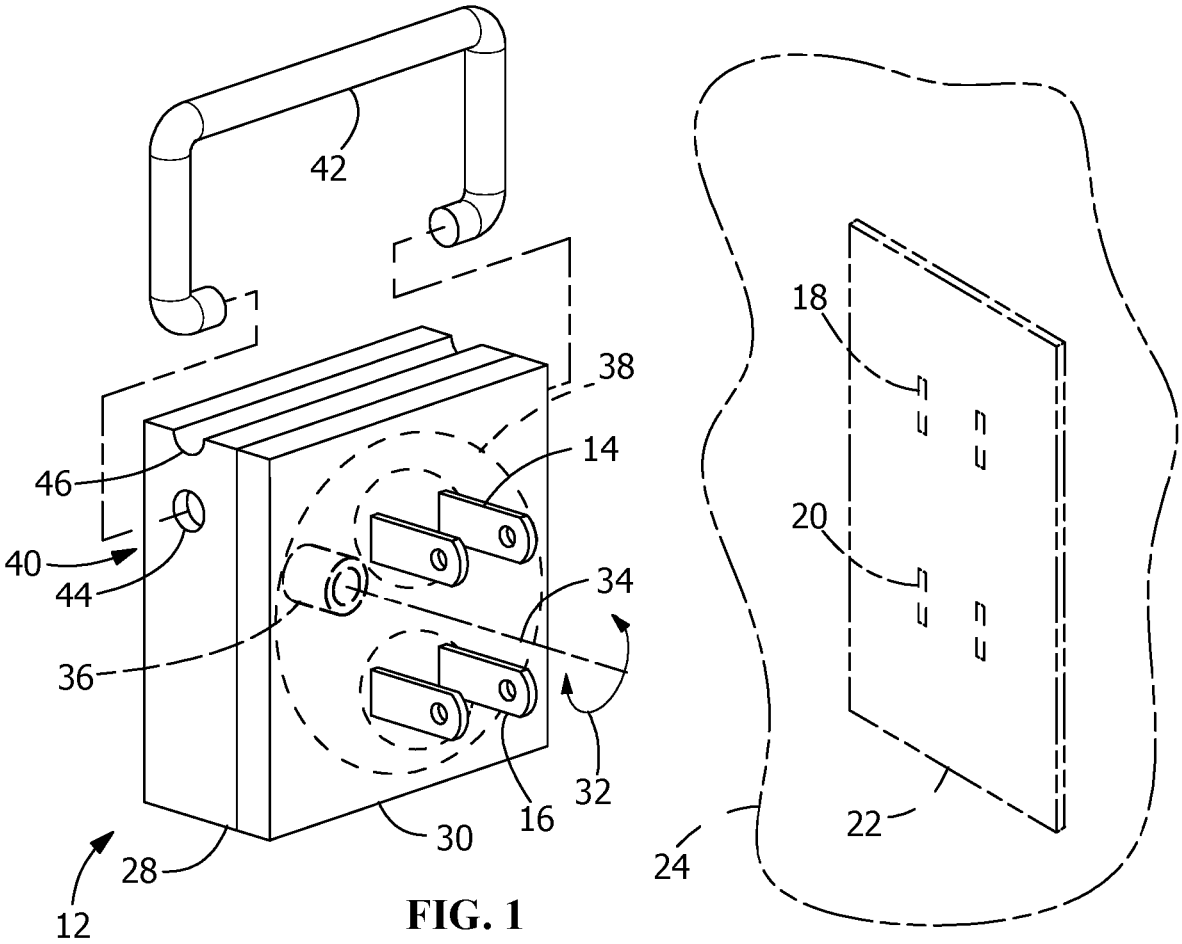
FIG. 1 is a partially exploded upper perspective view of an exemplary outlet tap.

As shown in FIG. 1, an outlet tap 12 includes at least a pair of prong outlets 14, 16 outwardly extending therefrom that is receivable by a corresponding pair of electrical outlets 18, 20 of a conventional electrical receptacle 22 mounted in a vertical wall 24 near a support surface 26 (FIG. 2) such as a floor that is being refinished. Outlet tap 12 includes body portions 28, 30 that are movable in a rotational direction 32 relative to one another about an axis 34 via a conductive member 36 operatively connected between body portions 28, 30. In one embodiment, each of prong outlets 14, 16 is independently rotatable about a corresponding axis, such as an axis parallel to axis 34. Body portion 30 includes a smaller body portion 38 that is movable in rotational direction 32 relative to body portion 30. In one embodiment, conductive member 36 permits electrical power provided from electrical outlets 18, 20 of electrical receptacle 22 to be provided through prong outlets 14, 16 to outlet tap 12 as needed. As a result of conductive member 36, prong outlets 14, 16 of outlet tap 12 may be rotated to accommodate a corresponding arrangement of electrical outlets 18, 20 of electrical receptacle 22, e.g., the electrical outlets 18, 20 being vertically positioned relative to one another or horizontally position relative to one another. That is, irrespective the arrangement of the electrical outlets 18, 20 of electrical receptacle 22, the orientation of body portion 28 of outlet tap 12 may be maintained, or adjusted to provide more precise control of air flow, as needed.

Figure 2:
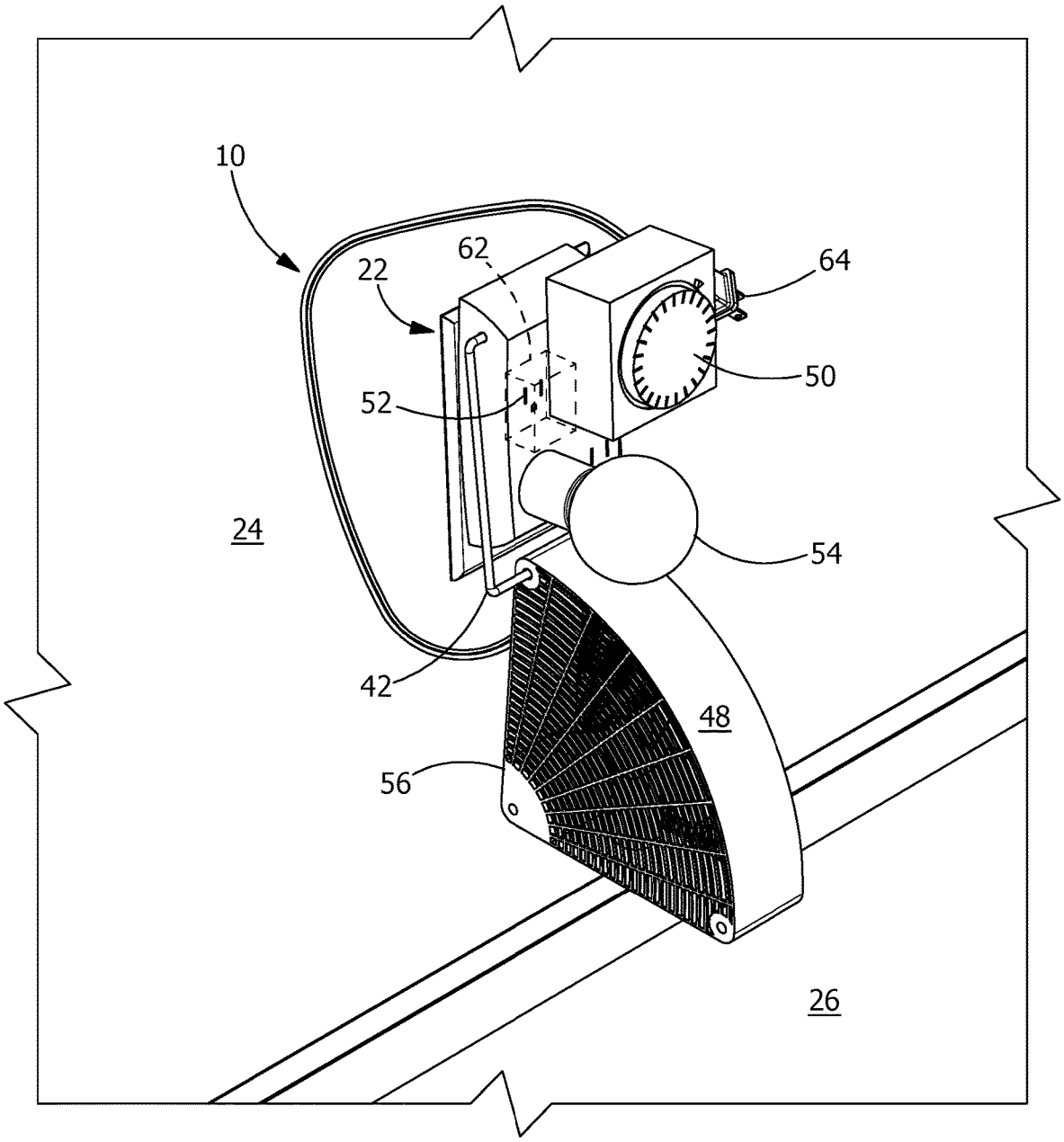
FIG. 2 is an upper perspective view of an exemplary air circulation system.

As further shown in FIG. 1, outlet tap 12 includes one or more securing features 40, such as a pair of opposed openings 44 (only one opposed opening 44 is shown in FIG. 1) formed in body portion 28 permitting a support member 42, such as a generally loop-shaped member, such as formed by bending a rod or by molding or other technique to be received or operatively connected thereto. In one embodiment, securing feature 40 may be a recess 46 formed in body portion 28, by itself or in combination with opposed openings 44. In one embodiment, support member 42 may be a flexible member, so long as support member 42 is capable of functioning as intended, such as suspendedly supporting a fan 48 (FIG. 2) above support surface 26 (FIG. 2). In one embodiment, fan 48 is a bi-directional fan.

Figure 3:
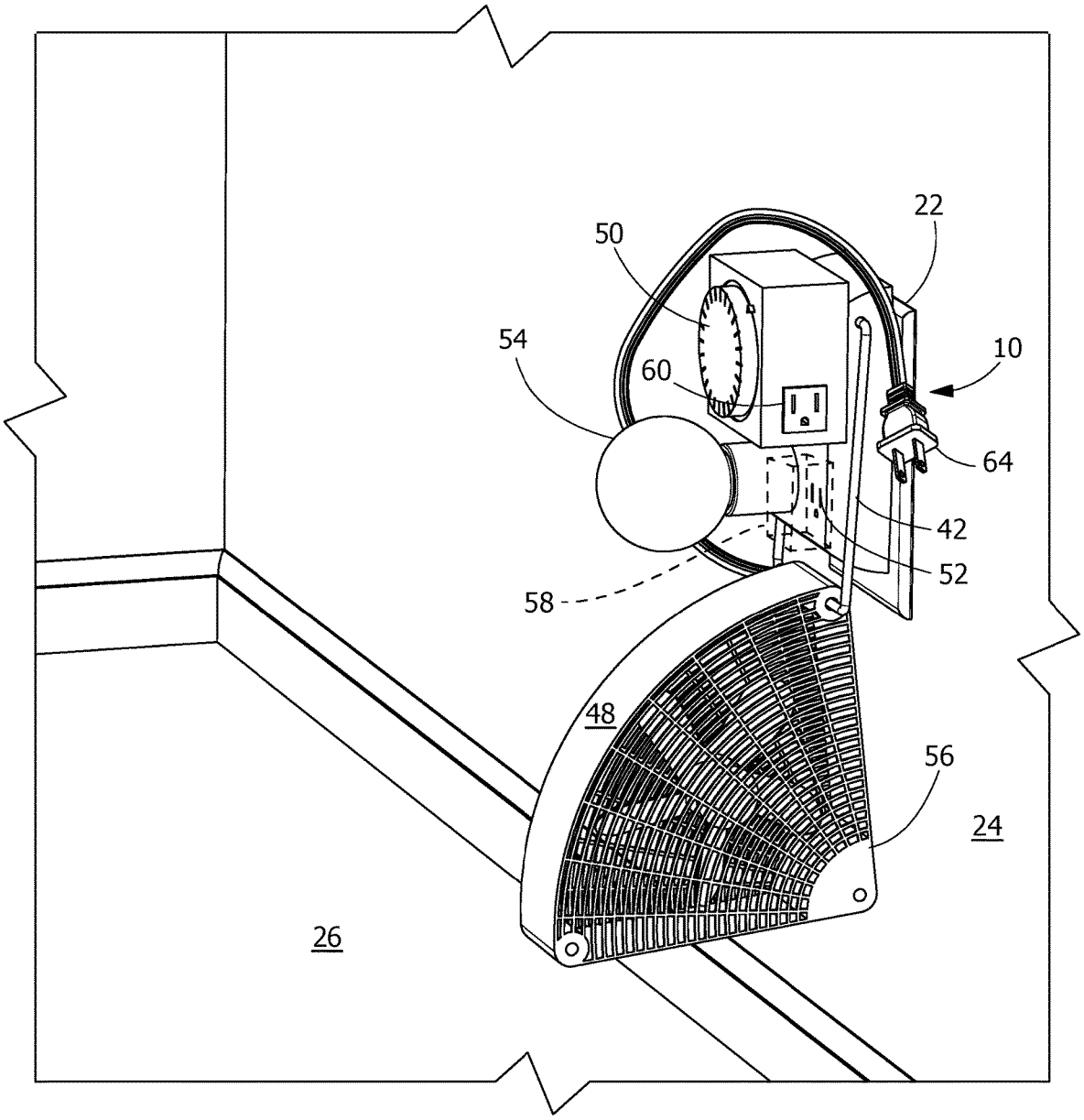
FIG. 3 an upper perspective view of the air circulation system of FIG. 2 rotated about a vertical axis.

As shown in FIGS. 2 and 3, an exemplary embodiment of the air circulation system 10 of the present invention is now discussed. Air circulation system 10 includes outlet tap 12 that is shown being received by electrical receptacle 22. As further shown, each of a timer 50 and an illumination source 54 such as an ultraviolet (UV) light or a light emitting diode (LED) light is connected to a corresponding electrical outlet 52 of outlet tap 12. In one embodiment, fan 48 includes a heating element 56 for heating the air directed through the fan 48, if desired. Optionally, as shown in FIG. 3, a humidistat 58 is connected to a corresponding electrical outlet 52 of outlet tap 12. In one embodiment, a battery 62 is connected to a corresponding electrical outlet 52 of outlet tap 12. In one embodiment, one or more of timer 50 illumination source 54, and heating element 56 may be connected to a different electrical receptacle than electrical outlets 52 of outlet tap 12, such as an electrical receptacle that may be associated with any of timer 50, illumination source 54 and humidistat 58 for controlling the humidity level in a working space, such as for preventing the formation of mold or mildew. For example, as further shown in FIG. 3, timer 50 includes an electrical receptacle 60, such as for receiving the electrical power plug 64 for fan 48. As shown in FIGS. 2 and 3, fan 48 is oriented to flow air generally parallel to a corner defined by an intersection of vertical wall 24 and support surface 26. In one embodiment, fan 48 may be oriented, such as directing air in a direction that is non-parallel to the corner, i.e., including directing the air flow upwardly or downwardly relative to support surface 26, and/or directing the lateral aspect of the air flow toward or away from the corner or vertical wall 24.

In one embodiment, illumination source 54 is incorporated into humidistat 58

As is appreciated by one having ordinary skill in the art, air circulation system 10 provides support such as by support member 42 for suspendedly supporting a robust fan having an output of 100 CFM or more above a floor, without requiring any additional equipment other than a conventional wall-mounted electrical receptacle. That is, fans having sufficient output to be usable for floor refinishing or mold and mildew control are too heavy to be suspended only by their power cords, and would not be operated in that fashion by those having ordinary skill in the art for at least safety reasons, and would therefore, otherwise require additional supporting hardware.

Figure 4:
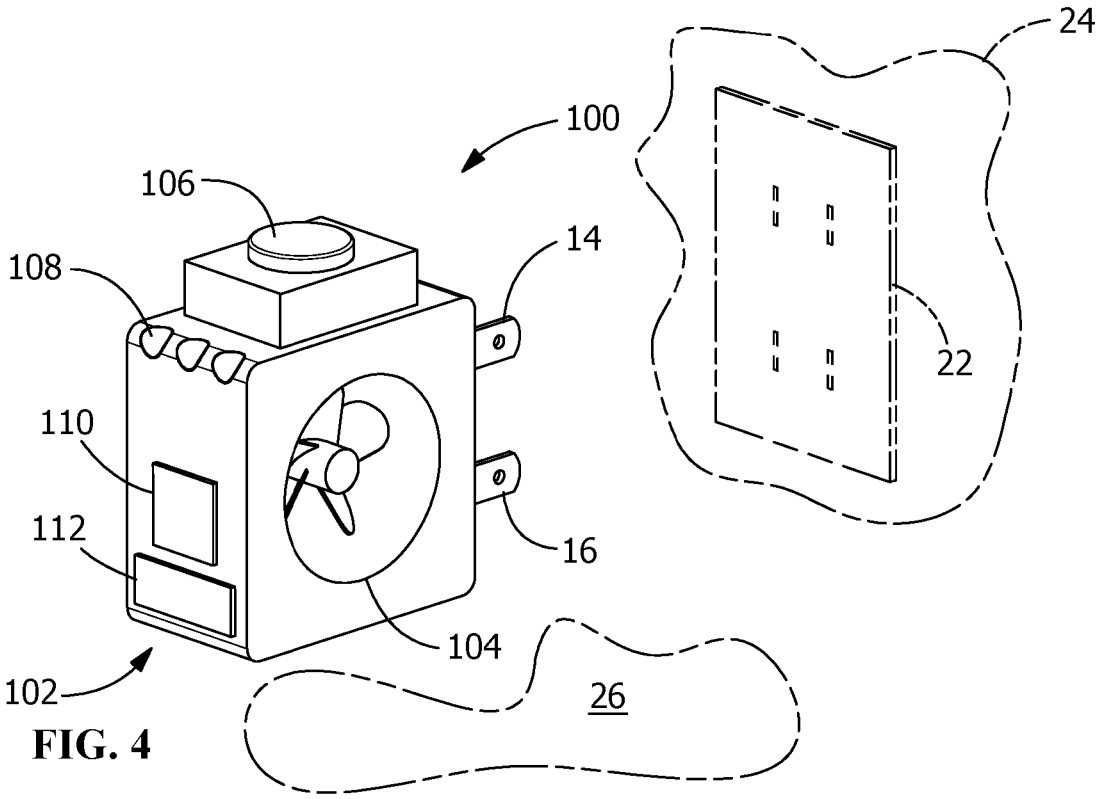
FIG. 4 is an upper perspective view of an exemplary air circulation system.

As shown in FIG. 4, an air circulation system 100 is now discussed. Air circulation system 100 operates in a similar fashion as air circulation system 10, with only notable differences being further discussed herein. For example, an outlet tap 102 of air circulation system 100 includes a fan 104 formed as a single unit, the fan 104 vertically supported above support surface 26 solely by outlet tap 102 being received by electrical receptacle 22 mounted to vertical wall 24 and positioned near support surface 26. As further shown, outlet tap 102 includes a timer 106, illumination sources 108, and humidistat 110 formed as a single unit in outlet tap 102. Optionally, a battery 112 is formed as a single unit in outlet tap 102, which ensures continuous electrical power is provided to the air circulation system.

It is appreciated that the air circulation system of the present application may be used in high-humidity area including, for example basements, recreational vehicles, storage units and the like.

The aspects and embodiments of the invention can be used alone or in combinations with each other.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An air circulation system comprising: an outlet tap having a pair of prong outlets receivable by a corresponding pair of electrical outlets of an electrical receptacle mounted to a vertical wall and positioned near a support surface, the outlet tap having at least two electrical outlets opposite the pair of prong outlets for providing electrical power from one or both of the electrical outlets of the electrical receptacle; a support member operatively connected to the outlet tap, the support member adapted to suspendedly support a fan vertically above the support surface in a first position that flows air in a first direction and a second position that flows air in a second direction different than the first direction; and a timer and a humidistat connectable to corresponding electrical outlets of the at least two electrical outlets of the outlet tap for selectively controlling operation of the fan, and wherein a body portion of the outlet tap includes a recess at each side of the body portion to receive each end of the support member.

2. The air circulation system of claim 1, wherein the fan is a bi-directional fan.

3. The air circulation system of claim 1, wherein the fan is oriented to flow air parallel to a corner defined by an intersection of the vertical wall and the support surface.

4. The air circulation system of claim 1, further comprising an illumination source connectable to a corresponding electrical outlet of the at least two electrical outlets of the outlet tap.

5. The air circulation system of claim 4, wherein the illumination source is taken from the group consisting of an ultraviolet light and an LED light.

6. The air circulation system of claim 5, wherein the illumination source is incorporated into the humidistat.

7. The air circulation system of claim 1, wherein the pair of prong outlets is rotatable about an axis.

8. The air circulation system of claim 1, wherein each prong outlet of the pair of prong outlets is rotatable about a corresponding axis.

9. The air circulation system of claim 1 further comprising a battery supported vertically above the support surface in response to the outlet tap being received by the electrical receptacle.

10. The air circulation system of claim 1, wherein the support member is loop-shaped that is connected to a body portion of the outlet tap.

11. The air circulation system of claim 1, wherein the support member rotates within the recess to enable movement of the fan.

12. The air circulation system of claim 1, wherein the support member rotates within the recess to enable rotation of the fan in at least two directions.

13. The air circulation system of claim 12, wherein the support member includes a first end that is connected to a first side of the outlet tap and a second end that is connected to a second side of the outlet tap, the second side being opposite to the first side.

14. The air circulation system of claim 12, wherein the outlet tap includes a first body portion and a second body portion rotatable about an axis with respect to the first body portion.

15. The air circulation system of claim 14, further comprises a conductive member operatively connected between the first body portion and the second body portion.

16. The air circulation system of claim 14, wherein the conductive member is configured to permit electrical power provided from the electrical outlets of the electrical receptacle to be provided through the pair of prong outlets of the outlet tap.

17. The air circulation system of claim 14, wherein at least one of the first body portion or the second body portion includes a smaller body portion that is moveable in a rotational direction relative to the least one of the first body portion or the second body portion.

18. An air circulation system comprising: an outlet tap having a pair of prong outlets receivable by a corresponding pair of electrical outlets of an electrical receptacle mounted to a vertical wall and positioned near a support surface, the outlet tap providing electrical power from one or both of the electrical outlets of the electrical receptacle; the outlet tap further including a fan formed as a single unit, the fan vertically supported above the support surface solely by the outlet tap being received by the electrical receptacle, the fan being supported by the outlet tap in a first position to flow air in a first direction and in a second position to flow air in a second direction different than the first direction while plugged in the electrical outlets of the electrical receptacle; and the outlet tap further including a timer and a humidistat incorporated as a single unit, the timer and the humidistat for selectively controlling operation of the fan, and wherein a body portion of the outlet tap includes a recess at each side of the body portion to receive each end of the support member.

* * * * *